United States Patent [19]

Tanaka et al.

[11] 4,220,696

[45] Sep. 2, 1980

[54] ELECTROPHOTOGRAPHIC PLATE WITH MULTIPLE LAYERS

[75] Inventors: Susumu Tanaka, Sakai; Katsutoshi Konishi, Fujiidera, both of Japan

[73] Assignee: Minolta Camera Kabushiki Kaisha, Osaka, Japan

[21] Appl. No.: 553,448

[22] Filed: Feb. 24, 1975

Related U.S. Application Data

[63] Continuation of Ser. No. 151,713, Jun. 10, 1971, abandoned.

[51] Int. Cl.[2] ..... G03G 5/14; G03G 5/082

[52] U.S. Cl. ..... 430/59; 430/85; 430/57; 430/58

[58] Field of Search ..... 96/1.5, 1.6, 1 R

[56] References Cited

U.S. PATENT DOCUMENTS

| | | | |
|---|---|---|---|
| 2,803,541 | 8/1957 | Paris | 96/1.5 |
| 3,355,289 | 11/1967 | Hall et al. | 96/1.5 |
| 3,725,058 | 4/1973 | Hayashi et al. | 96/1.5 |

*Primary Examiner*—Roland E. Martin, Jr.
*Assistant Examiner*—John L. Goodrow
*Attorney, Agent, or Firm*—Watson, Cole, Grindle & Watson

[57] ABSTRACT

An electronic photograph photosensitive plate composed of a high resistant semiconductor layer placed on a conductive base plate and forming a high commutating barrier to check electric charge against coming in from said base plate side, a thin layer consisting of a panchromatic photoconductor in low resistance and high sensitivity placed on said layer to absorb light rays and generate charge carriers, and a transparent high resistant semiconductor layer placed further thereon to hold electric charge and serve as a passage for charge carriers generated.

10 Claims, 5 Drawing Figures

ELECTROPHOTOGRAPHIC PLATE WITH MULTIPLE LAYERS

This is a continuation of application Ser. No. 151,713 filed June 10, 1971, now abandoned.

BACKGROUND OF THE INVENTION

The present invention relates to an electronic photograph photosensitive plate of the Carlson form and more particularly relates to a photosensitive plate composed of three layers of a high resistant semiconductor layer formed on a conductive base plate, a thin layer of a photoconductor in low resistance and high sensitivity on said layer, and a transparent high resistant semiconductor layer placed further thereon.

The electronic photograph photosensitive plate used most popularly in the prior art is constructed by coating an aluminium base plate with non-crystalloid selenium to the thickness from 30μ to 80μ by means of the vacuum evaporation method. However, the photoconductive layer consisting of the non-crystalloid selenium generates charge carriers and at the same time holds the electric charge and serves as a passage for the photocharge carriers generated, therefore, only in order to generate charge carriers such thickness as several tens of μ is not required and the thickness less than about 1μ or so is enough. Besides, forming the high resistant semiconductor thickly like this is deprived of the flexibility of the photosensitive body and becomes expensive.

Thereupon, in order to improve said photosensitive plate to enlarge the spectral absorption area of the photosensitive plate to the long wave side and better the sensitivity thereof it has been tried to mix the tellurium into the selenium, however, as the mixing quantity of tellurium is increased the electrical resistance of the photoconductive layer is suddenly dropped and the function for holding the electric charge is lowered to quicken the dark decay, and accordingly only up to several percents in the maximum weight ratio the tellurium can not be mixed. And as the result it is impossible to improve widely the sensitivity and also obtain the good panchromatic property.

Whereas, a photosensitive plate composed of two layers has been proposed, which in order to better the photo-permeability of the photosensitive plate the photoconductive layer of selenium is formed to the thickness less than 1μ and provided thereon with a layer consisting of an organic photoconductive material in thickness more than 10μ. The selenium layer in said photosensitive plate also is required to withhold the mixing of tellurium under several percent in order to hold the high resistance and it is difficult to improve the sensitivity higher than the prior sensitivity, however, it becomes possible to improve the flexibility of the photosensitive plate.

As for such a two-layer photosensitive plate, according to my study the selenium layer is thinkable mainly to take partial charge of the function for generating charge carriers through the light absorption and on the other hand the organic photoconductive layer is thinkable mainly to take partial charge of the function for holding the electric charges and serving as a passage for photocharge carriers generated, and accordingly both photoconductive layers are thinkable to take respectively partial charge of the function with which the electronic photograph photosensitive plate is endowed, however, as described above the flexibility of photosensitive plate can be improved but the panchromatic property and the sensitivity thereof can not be improved yet.

OBJECTS OF THE INVENTIONS

One object of the present invention is to provide an electronic photograph photosensitive plate which improves the panchromatic property in holding the characteristics the prior electronic photograph photosensitive plate described above and betters the sensitivity thereof.

Another object of the present invention is to provide an electronic photograph photosensitive plate which is better in the panchromatic property as compared with the prior photosensitive plate, high in the sensitivity, rich in the resolving power, and endowed with the appropriate flexibility and accordingly convenient to use repeatedly when transferred.

The other objects of the present invention will be cleared in the detailed description disclosed hereinafter.

SUMMARY OF THE INVENTION

In order to attain the above-mentioned objects the present invention relates to an electronic photograph photosensitive plate composed of a high resistant semiconductor layer placed on a conductive base plate and forming a high commutating barrier to check electric charge against coming in from said base plate, a thin layer consisting of a panchromatic photoconductor in low resistance and high sensitivity placed on said layer to absorb light rays and generate charge carriers, and a transparent high resistant semiconductor layer placed further thereon to hold electric charge and serve as a passage for photocharge carriers generated.

DESCRIPTION OF THE PREFERRED EMBODIMENT

Figure 1A:
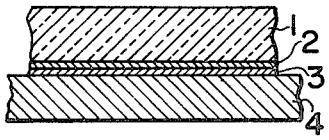
FIG. 1 is a sectional view of an embodiment of an electronic photograph photosensitive plate in accordance with the present invention, wherein A uses an aluminium plate as a conductive base plate and B is provided with a conductive base plate formed by evaporating the aluminum onto a flexible film.
Figure 1B:
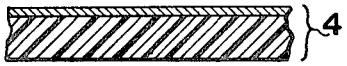

With reference to the accompanying drawings the construction of an electronic photograph photosensitive plate in accordance with the present invention will be described in detail hereinafter. First of all, in FIG. 1 reference numeral 1 denotes an upper side high resistant semiconductor layer, a high panchromatic photoconductive layer in low resistance and high sensitivity, 3 a lower side high resistant semiconductor layer, and 4 a conductive base plate, and these layers are respectively laminated firmly. Said conductive base plate 4 can be one made of an aluminium plate itself shown in FIG. 1A or one formed by evaporating in vacuum the aluminium onto a flexible film as shown in FIG. 1B.

Said upper side semiconductor layer 1 aims principally to hold electric charge on the surface thereof and pass the photocharge carriers generated in said photoconductive layer 2, and need not generate by itself photocharge carriers, so that a mere semiconductor as well as a photoconductor in low sensitivity can be used, however, it necessitates that the resistance value thereof is $10^{13}\Omega$ cm or so which holds electric charge and permits to pass photocharge carriers, and without forming a high barrier through contact with photoconductive layer 2 photocharge carriers are poured from photoconductive layer 2 and yet the material thereof has the photopermeability enough to enable light rays to get the photoconductive layer 2 when exposed from the above of upper side semiconductor layer 1. For example, polyvinylcarbazole, polyimid resin, polyvinyl, naphthalene, polyvinyl-Malachite Green, etc. are appropriate. The thickness of said semiconductor is different depending upon a material used, however, required only to be able to hold electric charge on the surface, and upon thickening above need, passing of photocharge carriers gets worse so that in general it is desirable to be up to the maximum several tens $\mu$ or so.

Said photoconductive layer 2 is for absorbing light rays to generate charge carriers, and the thickness thereof is different depending upon a material used, however, within the limits of the thickness for absorbing light rays it can be fixed appropriately according to the purpose to use the photosensitive plate, in consideration of the quantity of charge carriers generated by optical exitation and the quantity of charge carriers generated by thermic exitation, namely, the light damping quantity of the surface potential and the dark decay quantity. However, in general it is desirable that the thin layer is less than $1\mu$ in consideration of the dark decay quantity, however, thickening above need is not desirable because the generating effective quantity of photocharge carriers is remarkably reduced. In the formation of the photosensitive plate in accordance with the present invention said photoconductive layer 2 is placed in a high electric field, so that the surface conductance is widely reduced by the electric field effect, therefore, even though a $S_e$–$T_e$ alloy for showing the whole panchromatic property of high content percentage of tellurium which fixed resistance value is less than $10^5\Omega$ cm is put to use as a material, the thickness of film of photoconductive layer 2 and semiconductor 1 is small, so that the lowing of the resolving power of the picture image caused by diffusion of charge carriers is not effected at all and a very clear image having a very high resolving power of 200 pieces/mm or so can be obtained, therefore, a whole panchromatic photoconductive material in low resistance and high sensitivity which was impossible to use in the prior Carlso form can be used. For said material, pay attention to a $S_e$–$T_e$ alloy which is rich in the evaporative property and it will be found that a $S_e$–$T_e$ alloy containing the tellurium of 10% weight ratio in the selenium can be used for practical use, however, it is most desirable to be 30% weight ratio or so. And, increasing the mixing quantity of tellurium decreases the crystallizing rate of the non-crystalloid body and improves widely the heat resistance property of the photosensitive plate to lengthen the life of repeating use when used for transfer.

Said lower side semiconductor layer 3 forms a high commutating barrier through contact with conductive base plate 4 and checks electric charge against coming into photoconductive layer 2 from said base plate 4 and at the same time permits charge carriers in the relation to couple with photocharge carriers generated in photoconductive layer 2 to pour out to said base plate 4, and yet it does not operate alone by itself and displays its function in combination with said conductive base plate 4, and accordingly selection of the material is required to be fixed as a matter of course in combination with a conductive material. According to experiments, when a thin film of non-crystalloid selenium in high purity and in thickness less than $1\mu$ is put to use as semiconductor layer 3, as a conductive material for base plate 4 aluminum, antimony, tin, etc. which are in a great difference of the work function from selenium form respectively a high commutating barrier to bring about a good result, while in gold, silver, nickel, etc. dark decay gets larger respectively or account of electric charge poured to put to inconvenience.

In the photosensitive plate in accordance with the present invention, as the results of experiments the case of that the high resistant material of semiconductor layer 3 is a non-crystalloid selerium and combined with base plate 4 which conductive material is an alminum is most appropriate, however, the other high resistant chalcogen glass semiconductor such as $A_{s2}$, $S_3$, $A_{s2}S_{e3}$, etc. and an aluminum base plate shows a good result. In addition, a combination of an organic semiconductor such as polyvinylcarbazole and a metal such as aluminium or copper can be used as well. A combination of a high resistant semiconductor and a material for forming a barrier through contact with a metal in such a manner can be selected in a wide range.

Such being the case described above, the thickness of said semiconductor layer 3 is only required to form a high commutating barrier through contact with conductive base body 4 and can be very thin as compared with the upper side semiconductor layer, and yet in order to flow out quickly charge carriers of the reverse polarity hard to move as compared with photocharge carriers generated in photoconductive layer 2 to base plate 4, in general the thin film less than $1\mu$ is desirable.

As a formation of conductive base plate 4, a conductive base plate formed by evaporating in vacuum a a metal such as aluminum, antimony onto a tough film such as a polyester film becomes flexible and the whole of the photosensitive plate shows the flexibility, so that an upper side semiconductor layer made of a macromolecule material such as an organic semiconductor can be easily formed into a belt-shaped photosensitive plate.

When forming an image on the photosensitive plate formed as described above in the Carlson form, the charged polarity thereof is fixed by a majority of bearing bodies generated in photoconductive layer 2, so that when a majority of charge carriers are positive holes it is required to charge negatively and when they are electrons it is required to charge positively.

Now, in the case of that photoconductive layer 2 is made of a material in which positive holes are a majority of charge carriers, for example, $S_e$-$T_e$ alloy, upon applying a negative corona discharge from the above of upper side semiconductor layer 1 of the phtosensitive plate in a dark place, a negative charging is uniformly brought about onto the surface of semiconductor layer 1 and said negative charging is checked against pouring into photoconductive layer 2 though a high barrier formed between lower side semiconductor layer 3 and said base plate 4 by positive electric charge induced in conductive base plate 4 and accordingly carried out efficiently to be formed to a high potential. After then, upon applying exposure from upper side semiconductor layer 1 by means of a white light source the light rays pass through semiconductor layer 1 to get to photoconductive layer 2, however, on account of the thin layer of said photoconductive layer 2 said light rays optically excite the whole of said layer 2 without diffusing the light, and in photoconductive layer 2 a great number of positive holes are generated through the high sensitive high panchromatic property and attracted by negative electric charge on the surface of semiconductor layer 1 to move to semiconductor layer 1 side without recoupling with electron. And, positive holes generated by optical-exitation are scarcely seized photoconductive layer 2 on account of the thin layer of photoconductive layer 2 itself and its low resistance and can be quickly moved, and are scarcely diffused in semiconductor layer 1 on account of the thin layer thereof to pass therethrough so as to function to neutralize negative electric charge on the surface of said semiconductor layer 1; and on the other hand are seized by the boundary surface between photoconductive layer 2 and semiconductor 3 or flowed out to base plate 4 side. In this manner, it is thinkable that an electrostatic image of the high resolving power in high contrast can be formed.

In said photosensitive plate, upon increasing the thickness of photoconductive layer 2 more than need, for example, to several $\mu$ thickness in the case of $S_e$-$T_e$ alloy, the portion optically excited is only up to one $\mu$ or so of the upper side so that the remaining portion not optically excited of the lower side functions only as a passage for free electrons, and not only be useless to better the sensitivity but also free electrons are apt to be seized by the remaining portion resulting in lowering the contrast undesirably.

As described above, the present invention is able to turn photoconductive layer 2 to the high sensitive panchromatic property by forming the lower side high resistant semiconductor layer between photoconductive layer 2 and conductive base plate 4, and in the well known photosensitive plate disclosed in the Patent Publication No. 16198/1968, even though the quantity of tellurium added to the selenium of the photoconductive layer thereof is increased to better the sensitivity, the sensitivity is improved but the dark decay gets severe and accordingly can not be put to practical use.

In addition, in said example in order to decrease the dark decay, upon interposing an insulator such as polystyrene proposed for the purpose to check electric charge against pouring from the base plate to the photoconductive layer in the prior photosensitive plate between said photoconductive layer and conductive base plate, the pouring of electric charge is checked and the dark decay is prevented, but the contrast of electrostatic image formed by the picture image exposure is lowered and gets unsuitable to put to practical use, therefore, it can be said that this is not improved till the present invention is embodied as described above.

Next, as compared with the prior photosensitive plate the electronic photograph characteristics of the photosensitive plate functioning described above in accordance with the present invention are as follows:

In FIG. 2, curves a, b, c show respectively various electronic photograph characteristics of the photosensitive plate in accordance with the present invention in the case of that a $S_e$-$T_e$ alloy is put to use as high panchromatic photoconductive layer in low resistance and high sensitivity 2, wherein curve a shows the case of that a $S_e$-$T_e$ alloy in which the sellenium contains the tellunium 20% is put to use, curve b shows the case of that a $S_e$-$T_e$ alloy in which the sellenium contains the tellunium 30% is put to use, and curve c shows the case of that a $S_e$-$T_e$ alloy in which the sellenium contains the tellunium 45% is put to use. And, curve d shows an example of the electronic photograph characteristic of the prior sellenium photosensitive plate and curve e shows an example of the prior two-layer laminated photosensitive plate of an organic photoconductive material and a sellenium.

Figure 2A:
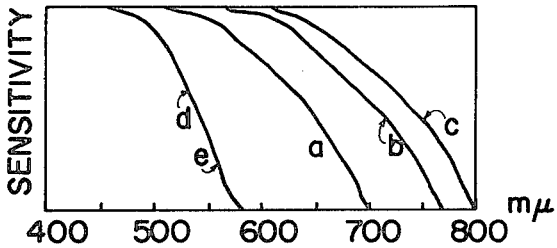
FIG. 2 is a diagram showing the electronic photograph characteristics of an electronic photograph photosensitive plate of an embodiment in accordance with the present invention, in comparing with those in the prior art, wherein A shows the spectral sensitivity characteristic, B the light decay characteristic, and C the dark decay characteristic.

FIG. 2A is a diagram for comparing the spectral sensitivity characteristics, and from this diagram it is understood of the photosensitive plate in accordance with the present invention that the spectral sensitivity is lengthened greatly to the long wave side longer than the prior photosensitive plate, and the photosensitive plate grows to the high sensitivity for a white light source such as a tungsten-filament lamp and that the photosensitive plates containing the tellunium more than 30% show almost the whole panchromatic property so as to enable to reproduce color photographs and any color picture image, and thus the photsensitive plate having the ideal spectral sensitivity characteristic can be formed.

Figure 2B:
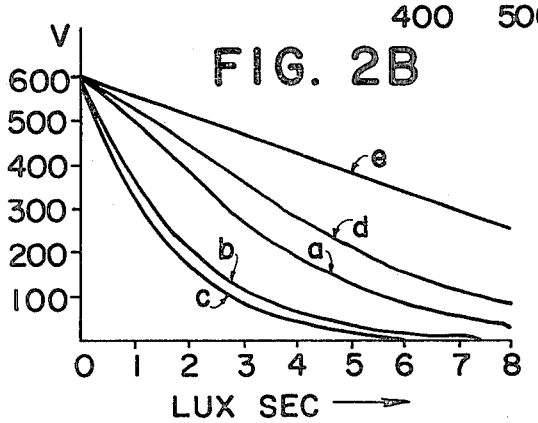

FIG. 2B is a diagram for comparing the light decay characteristics showing the electrostatic latent image forming rate of the photosensitive plate, and from this diagram it is understood that characteristics a, b, c of the photosensitive plate in accordance with the present invention are greatly improved in the sensitivity as compared with the prior photosensitive plate.

Upon forming images by making use of the photosensitive plate of curve b clear images in very high contrast can be obtained with the light quantity of 1 lux sec.

Figure 2C:
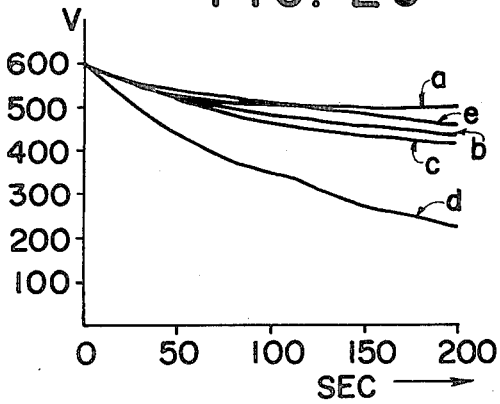

FIG. 2C is a diagram for comparing the dark decay characteristics showing the electric charge bearing capacity of the photosensitive plate, and also from this diagram it is understood that the characteristics are improved considerably as compared with the prior selenium photosensitive plate (curve b) so that the photosensitive plate very convenient in practical use can be obtained. And, as compared with the prior organic photoconductive material and $S_e$ laminated photosensitive plate (curve e), it is understood that said characteristic is the nearly similar dark decay value and below a little according as the containing quantity of the tellurium is increased. This fact is thinkable to be mainly by reason of that in the case of that $S_e$-$T_e$ alloy layers are in the same film thickness the quantity of positive holes generated by being thermally excited by the electric field applied to the photosensitive plate is increased according as the containing quantity of the tellurium is increased, and to be different from the dark decay caused mainly by pouring of electric charge from the base plate metal as seen in the prior selenium photosensitive plate.

Therefore, speaking only of the phase of the dark decay characteristic it is desirable that according as the containing quantity of the tellurium in a $S_e$-$T_e$ alloy layer gets more, namely, the whole panchromatic property in low resistance and high sensitivity in a photoconductive layer gets greater, the film thickness thereof is made thiner.

Next, examples of the electronic photograph photosensitive plate in accordance with the present invention will be described hereinafter.

EXAMPLE I

A photosensitive plate was made in such manners as after buffing an aluminium plate having the flat surface and then washing with petroleum solvent and cleaning up in the ion bombard method to form conductive base plate 4, and then evaporating in vacuum the selenium of the purity more than 99.99% onto said base plate 4 to the thickness 0.5μ or so in the vacuum of $10^{-5}$ mm Hg to form lower side high resistant semiconductor layer 3, and continuously mixing 20% in weight of the tellurium of the purity 99.999% into the selenium of the purity 99.999% and enclosing in the vacuum said mixture to heat up to the temperature from 450° to 500° C. in an electric furnace and stirring up to mix them for one hour; thus a $S_e$-$T_e$ alloy made by quickly cooling was evaporated to the thickness about 1.0μ in the vacuum of $10^{-5}$ mm Hg in the flash method to coat high panchromatic photoconductive layer 2 in low resistance and high sensitivity and then applied with the organic semiconductor paints of the composition shown in the following table to the thickness 80μ by means of a doctor or a roll, and dried in the temperature 40° for about one hour to coat transparent high resistant semiconductor layer 1 with a dry film of 8μ.

Composition Table

| Component | Weight Portion |
|---|---|
| Polyvinylcarbazol | 100 |
| Diphenyl Trichloride | 40 |
| Monochlorobenzen | 1000 |

After charging said photosensitive plate to the surface potential of −500 V by means of a corona discharge device and projecting the picture image with the illuminance of 1 lux on the average for one second by means of an enlarger using a tungsten-filament lamp of 2800° K. as a light source, it was developed in the magnetic brushing method, however, a very clear visible image of the high resolving power could be obtained. And, by transferring said visible image, even though said photosensitive plate was repeatedly used a clear visible image could be obtained still in the same manner.

EXAMPLE II

Conductive base plate 4 formed by evaporating in vacuum an aluminum thin film onto a polyester film of 80μ was ion-bombarded for about 15 minutes under voltage impression of 15000 V in the low vacuum of $10^{-2}$ mm Hg order. After then, by evaporating in vacuum an $A_{s2}S_3$ to about 1μ to form layer 3 and further evaporating $S_e$-$T_e$ alloy including the tellurium of 30% weight ratio in the vacuum of $10^{-5}$ mm Hg in the flash method; thus a thin film of 0.8μ thickness was obtained, and so by coating layer 2 with said thin film and applying on the surface thereof with the organic semiconductor paints in the same way as in Example I to form the dry film into the thickness 7μ, layer 1 was formed and thus a photosensitive plate was made. After charging said photosensitive plate to −400 V and projecting the picture image with the illuminance of 1 lux for 0.8 second by means of an enlarger using a white tungsten-filament lamp as a light source, it was developed in the magnetic brushing method, however a clear visible image having an enough concentration could be obtained.

And, said photosensitive plate was very pliable and perfectly flexible, and could be used in forming easily into the belt shape.

EXAMPLE III

By evaporating in vacuum the selenium of the purity more than 99.99% onto a polyester film base 4 evaporated with the antimony to the thickness 0.6μ in the vacuum of $10^{-5}$ mm Hg to form layer 3 and further evaporating Se-Te alloy including the tellurium of 4.55% weight ratio in the vacuum of $10^{-5}$ mm Hg in the flash method, layer 2 of the thin film of 0.8μ thickness was obtained and by applying thereon with the organic semiconductor paints shown in the above table to form the dry film of thickness 10μ, layer 1 was formed and thus a photosensitive plate was made.

After charging said photosensitive plate to the surface potential −400 V and projecting the picture image with the illuminance of 1 lux for 0.2 second by means of an enlarger using a white tungsten-filament lamp as a light source it was developed in the magnetic brushing method, however, a clear visible image having the enough concentration could be obtained.

By the way, in said examples, only typical Se-Te alloy which is rich in the evaporation proper as whole panchromatic photoconductive layer 2 in low resistance and high sensitivity has been described, however, also in the other materials which are rich in the low resistance high sensitivity panchromatic property, for example, AsSe, SeSb, crystal selenium, etc. it is clear from the above-description to be able to carry out in the same way.

What is claimed is:

1. An electrophotographic sensitive plate, comprising:

a conductive base;

a semiconductive layer selected from the group consisting of Se, $As_2S_3$ and $As_2Se_3$ having a thickness of less than 1 micron overlaying said base;

a photoconductive layer of a mixture of selenium and tellurium disposed on said semiconductive layer and containing between 10 to 60 percent tellurium by weight and having a thickness no greater than 1 micron; and an organic semiconductive layer selected from the group consisting of polyvinylcarbazole polyamide resin, polyvinyl-naphthalene and polyvinyl-malachite green disposed on said photoconductive layer and having a thickness of 5 to 30 microns.

2. An electrophotographic sensitive plate according to claim 1, wherein said conductive base is selected from the group consisting of aluminum, antimony and tin.

3. An electrophotographic sensitive plate according to claim 1, wherein said mixture of selenium and tellurium contains about 30 percent of tellurium by weight.

4. An electrophotographic sensitive plate comprising:

a conductive base of aluminum;

a selenium layer less than 1 micron thick disposed on said base forming a rectifying barrier for preventing the penetration of electric charges from said base;

a selenium-tellurium layer containing between 20 to 40 percent tellurium by weight and having a thickness no greater than 1 micron disposed on said selenium layer for generating charge carriers upon absorption of light; and a polyvinyl-carbazole layer 5 to 30 microns thick disposed on said selenium-tellurium layer for retaining electric charges on its surface and for conducting photocarriers.

5. An electrophotographic sensitive plate, comprising:

a conductive base;

a semiconductive layer selected from the group consisting of Se, $As_2S_3$ and $As_2Se_3$ having a thickness in the range of 0.5 microns to 1.0 microns overlaying said base;

a photoconductive layer of a mixture of selenium and tellurium disposed on said semiconductive layer and containing between 10 to 60 percent tellurium by weight and having a thickness in the range of 0.8 microns to 1.0 microns; and an organic semiconductive layer selected from the group consisting of polyvinylcarbazole polyamide resin, polyvinyl-naphthalene and polyvinyl-malachite green disposed on said photoconductive layer and having a thickness in the range of 5 to 30 microns.

6. An electrophotographic sensitive plate as in claim 5, wherein the thickness of said first semiconductive layer is substantially 0.5 microns, the thickness of said photoconductive layer is substantially 1.0 microns, the thickness of said organic semiconductive layer is substantially 8 microns, and the percentage by weight of tellurium is substantially 20 percent.

7. An electrophotographic sensitive plate as in claim 5, wherein the thickness of said first semiconductive layer is substantially 1 micron, the thickness of said photoconductive layer is substantially 0.8 microns, the thickness of said organic semiconductive layer is substantially 7 microns, and the percentage by weight of tellurium in said photoconductive layer is substantially 30 percent.

8. An electrophotographic sensitive plate as in claim 5, wherein the thickness of said first semiconductive layer is substantially 0.6 microns, the thickness of said photoconductive layer is substantially 0.8 microns, the thickness of said organic semiconductive layer is substantially 10 microns, and the percentage by weight of tellurium in said photoconductive layer is substantially 45.5 percent.

9. An electrophotographic sensitive plate, comprising:

a conductive base;

a semiconductor layer selected from the group consisting of Se, $As_2S_3$ and $As_2Se_3$ having a thickness of less than 1 micron overlaying said base;

a photoconductive layer of a mixture of selenium with an element selected from the group consisting of Te, As, and Sb and containing between 10 to 60 percent of said element by weight and having a thickness no greater than 1 micron; and an organic semiconductive layer of a polyvinylcarbazole disposed on said photoconductive layer and having a thickness of 5 to 30 microns.

10. An electrophotographic sensitive plate as in claim 9, wherein said semiconductive layer has a thickness of 0.5 to 1 micron; and said photoconductive layer has a thickness of 0.8 to 1 micron.

* * * * *

UNITED STATES PATENT OFFICE

CERTIFICATE OF CORRECTION

PATENT NO. : 4,220,696

DATED : September 2, 1980

INVENTOR(S) : Tanaka et al

It is certified that error appears in the above-identified patent and that said Letters Patent are hereby corrected as shown below:

On the title page the following should be added:

-- [30] Foreign Application Priority Data

June 10, 1970 Japan ..... SHO 45-49467 --.

Signed and Sealed this

*Tenth* Day of *February 1981*

[SEAL]

*Attest:*

RENE D. TEGTMEYER

*Attesting Officer*

*Acting Commissioner of Patents and Trademarks*